US011448990B2

(12) United States Patent
Hirose

(10) Patent No.: US 11,448,990 B2
(45) Date of Patent: Sep. 20, 2022

(54) IMAGE FORMING APPARATUS, METHOD OF CONTROLLING SAME, AND STORAGE MEDIUM

(71) Applicant: CANON KABUSHIKI KAISHA, Tokyo (JP)

(72) Inventor: Fumiaki Hirose, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/376,451

(22) Filed: Jul. 15, 2021

(65) Prior Publication Data

US 2022/0050410 A1 Feb. 17, 2022

(30) Foreign Application Priority Data

Aug. 11, 2020 (JP) ..... JP2020-135930

(51) Int. Cl.
*G03G 15/00* (2006.01)

(52) U.S. Cl.
CPC ..... *G03G 15/5041* (2013.01); *G03G 15/5025* (2013.01); *G03G 15/5062* (2013.01)

(58) Field of Classification Search
CPC ..... G03G 15/5025; G03G 15/5041; G03G 15/5062
See application file for complete search history.

(56) References Cited

U.S. PATENT DOCUMENTS 8,830,522 B2 * 9/2014 Mizuno ..... G03G 15/5062 358/1.9
2013/0077105 A1 3/2013 Mizuno
2020/0319585 A1 10/2020 Hirose

FOREIGN PATENT DOCUMENTS

JP 2013-068800 A 4/2013

* cited by examiner

*Primary Examiner* — Hoang X Ngo
(74) *Attorney, Agent, or Firm* — Venable LLP

(57) ABSTRACT

An image forming apparatus includes an image forming device to form an image on a sheet, and an image reading device to read an image from the sheet. A processing unit causes the image forming device to perform a predetermined image formation to form a first image for position correction of an output image and a second image for tone correction. A value of the position correction is obtained, based on a read image, and a tone correction value is obtained based on a read image from a second image sheet.

10 Claims, 11 Drawing Sheets

510

TARGET VALUE

| CONCENTRATION | L1 | L2 | L3 | L4 | L5 | L6 | L7 | L8 | L9 | L10 |
|---|---|---|---|---|---|---|---|---|---|---|
| K | 102 | 205 | 307 | 405 | 512 | 617 | 717 | 819 | 922 | 1022 |
| Y | 103 | 210 | 309 | 412 | 513 | 615 | 717 | 820 | 923 | 1020 |
| M | 99 | 205 | 305 | 410 | 512 | 614 | 717 | 819 | 921 | 1016 |
| C | 100 | 207 | 307 | 408 | 510 | 611 | 713 | 820 | 920 | 1023 |

520

MEASUREMENT VALUE

| CONCENTRATION | L1 | L2 | L3 | L4 | L5 | L6 | L7 | L8 | L9 | L10 |
|---|---|---|---|---|---|---|---|---|---|---|
| K | 100 | 203 | 307 | 410 | 520 | 620 | 719 | 822 | 921 | 1018 |
| Y | 100 | 214 | 311 | 422 | 523 | 615 | 723 | 815 | 920 | 1010 |
| M | 110 | 207 | 309 | 411 | 512 | 619 | 710 | 824 | 923 | 1005 |
| C | 95 | 205 | 302 | 405 | 512 | 601 | 700 | 815 | 915 | 1020 |

530

CORRECTION VALUE

| CONCENTRATION | L1 | L2 | L3 | L4 | L5 | L6 | L7 | L8 | L9 | L10 |
|---|---|---|---|---|---|---|---|---|---|---|
| K | 2 | 2 | 0 | 4 | -8 | -3 | -2 | -3 | 1 | 4 |
| Y | 3 | -4 | -2 | -10 | -10 | 0 | -6 | 5 | 3 | 10 |
| M | -11 | -2 | -4 | -1 | 0 | -5 | 7 | -5 | -2 | 11 |
| C | 5 | 2 | 5 | 3 | -2 | 10 | 13 | 5 | 5 | 3 |

FIG. 5B

FIG. 7B

| | MEASUREMENT VALUE | IDEAL VALUE | CORRECTION VALUE |
|---|---|---|---|
| LEADING EDGE WRITE START POSITION | (M4+M8)/2 | 1cm | MEASUREMENT VALUE − IDEAL VALUE |
| LEFT EDGE WRITE START POSITION | (M3+M5)/2 | 1cm | MEASUREMENT VALUE − IDEAL VALUE |
| MAIN-SCANNING MAGNIFICATION | ((M1-M3-M7)+ (M1-M5-M9))/2 | MAIN SCANNING DIRECTION SHEET LENGTH -2cm | (MEASUREMENT VALUE − IDEAL VALUE) / IDEAL VALUE |
| SUB-SCANNING MAGNIFICATION | ((M2-M4-M6)+ (M2-M8-M10))/2 | SUB-SCANNING DIRECTION SHEET LENGTH -2cm | (MEASUREMENT VALUE − IDEAL VALUE) / IDEAL VALUE |

IMAGE FORMING APPARATUS, METHOD OF CONTROLLING SAME, AND STORAGE MEDIUM

CROSS-REFERENCE TO RELATED APPLICATIONS

This application claims the benefit of Japanese Patent Application No. 2020-135930, filed Aug. 11, 2020, which is hereby incorporated by reference herein in its entirety.

BACKGROUND OF THE INVENTION

Field of the Invention

The present invention relates to an image forming apparatus, a method of controlling the same, and a storage medium.

Description of the Related Art

In an image forming apparatus for forming an image on a sheet, a variation in the density of an output image may occur due to various causes. Such a density variation is not limited to electrographic image forming apparatuses, and is known to occur in image forming apparatuses of various printing methods such as an inkjet printing method and a thermal transfer method. As a technique for handling such density variation, a technique is known that actually forms a tone pattern on a sheet, and generates a tone correction table (correction data) based on density characteristics obtained by reading the tone pattern on the sheet by using a sensor (for example, Japanese Patent Laid-Open No. 2013-68800).

The density of the output image of the image forming apparatus tends to vary after the start of image formation and up until the image formation is performed in relation to a certain number of sheets. Accordingly, to obtain higher precision correction data, it is desirable to perform the reading of the tone pattern in a state in which, for example, the tone pattern (test chart) has been formed on a certain number of sheets such that the density characteristics of the output images has stabilized. However, when test charts are formed on many sheets, it can lead to pointless consumption of resources such as sheets and toner.

SUMMARY OF THE INVENTION

Accordingly, the present invention provides a technique for obtaining density correction data in a state in which the density characteristic of the output image is stabilized, without wasting the resources used for image formation.

According to one aspect, the present invention provides an image forming apparatus comprising an image forming unit configured to form an image on a sheet, an image reading unit configured to read an image from a sheet, a processing unit configured to output a sheet for which first processing was performed, and then output a sheet for which second processing for forming, by the image forming unit, an image of a predetermined pattern was performed; and an obtaining unit configured, based on a read image obtained by reading, by the image reading unit, the sheet for which the second processing was performed, to obtain density correction data to be used for image formation by the image forming unit.

According to another aspect, the present invention provides a method of controlling an image forming apparatus that comprises an image forming unit configured to form an image on a sheet and an image reading unit configured to read an image from a sheet, the method comprising outputting a sheet for which first processing was performed, and then output a sheet for which second processing for forming, by the image forming unit, an image of a predetermined pattern was performed, and, based on a read image obtained by reading, by the image reading unit, the sheet for which the second processing was performed, obtaining density correction data to be used for image formation by the image forming unit.

According to still another aspect, the present invention provides a non-transitory computer-readable storage medium storing a computer program for causing a computer to execute a method of controlling an image forming apparatus that comprises an image forming unit configured to form an image on a sheet and an image reading unit configured to read an image from a sheet, the method comprising outputting a sheet for which first processing was performed, and then output a sheet for which second processing for forming, by the image forming unit, an image of a predetermined pattern was performed, and, based on a read image obtained by reading, by the image reading unit, the sheet for which the second processing was performed, obtaining density correction data to be used for image formation by the image forming unit.

Further features of the present invention will become apparent from the following description of exemplary embodiments (with reference to the attached drawings).

BRIEF DESCRIPTION OF THE DRAWINGS

FIG. 5B illustrates an example of obtaining correction data for tone correction.

FIGS. 7A and 7B illustrate an example of obtaining correction data for geometric correction.

DESCRIPTION OF THE EMBODIMENTS

Figure 1A:
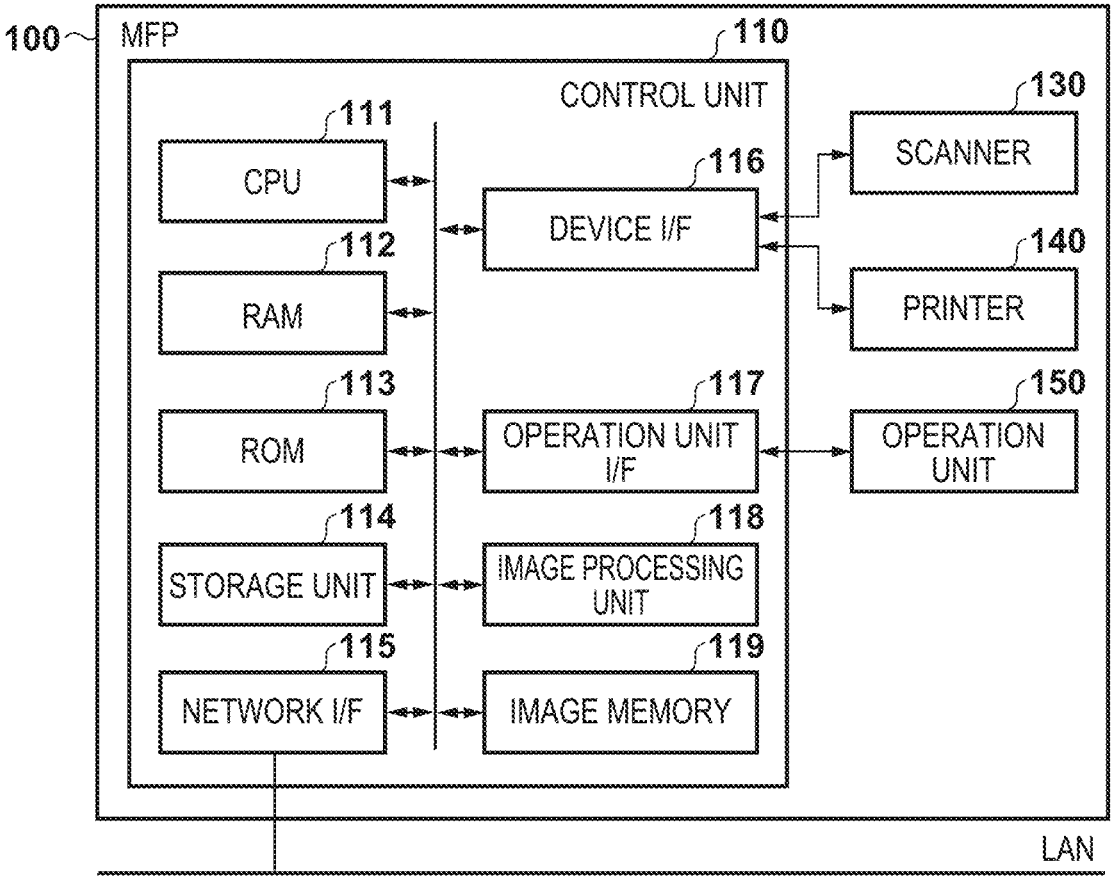
FIG. 1A is a block diagram illustrating an example of a hardware configuration of a multi-function peripheral (MFP).

Hereafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and a redundant description thereof is omitted.

Hereafter, a multi-function peripheral (MFP) will be described as an example of an image forming apparatus according to the present embodiment. Note that the image forming apparatus may be a printing apparatus, a printer, a copying machine, an MFP, or a facsimile apparatus, for example. The image forming apparatus may be an image forming apparatus that forms a monochrome image using a monochrome toner (developing material), but, in the present embodiment, an image forming apparatus that forms a multicolor image using a plurality of colors of toner is envisioned.

<MFP Hardware Configuration>

FIG. 1A is a block diagram illustrating an example of a hardware configuration of the MFP 100. The MFP 100 comprises a control unit 110, a scanner 130, a printer 140, and an operation unit 150. The scanner 130 is an image input device, and has an image reading function for reading an image from a sheet. The printer 140 is an image output device, and has an image forming function for forming an image on a sheet. The control unit 110 is connected to the scanner 130, the printer 140, and the operation unit 150. The control unit 110 controls operation of the MFP 100. The control unit 110 comprises a CPU 111, a RAM 112, a ROM 113, a storage unit 114, a network I/F (interface) 115, a device I/F 116, an operation unit I/F 117, an image processing unit 118, and an image memory 119.

The CPU 111 operates based on a program loaded into the RAM 112, and controls operation of the MFP 100. The ROM 113 is a boot ROM, and stores a boot program of the system. The storage unit 114 stores system software, various programs such as a control program of the MFP 100, and various data such as image data. The CPU 111 controls operation of the MFP 100 by loading a program stored in the storage unit 114 into the RAM 112 and executing it.

The network I/F 115 is connected to a LAN, and performs transmission/reception (for example, reception of a print job) of various information (data) in relation to an external apparatus by communication with the external apparatus via the LAN. The device I/F 116 is an interface for connecting the control unit 110 and each of the scanner 130 and the printer 140, and performs synchronous/asynchronous conversion of image data that is exchanged via the interface. The operation unit I/F 117 is an interface for connecting the operation unit 150 and the control unit 110, and outputs to the operation unit 150 image data for displaying an operation screen on the operation unit 150. Also, the operation unit I/F 117 receives information that the user inputs via the operation unit 150 from the operation unit 150 and transfers it to the CPU 111.

The image processing unit 118 performs, for example, image processing on image data. The image processing unit 118 performs image processing on print data received from an external apparatus via the LAN, and image processing on image data inputted from the scanner 130 via the device I/F 116 or to be outputted to the printer 140. The image memory 119 is a memory in which image data processed by the image processing unit 118 is temporarily stored.

Figure 1B:
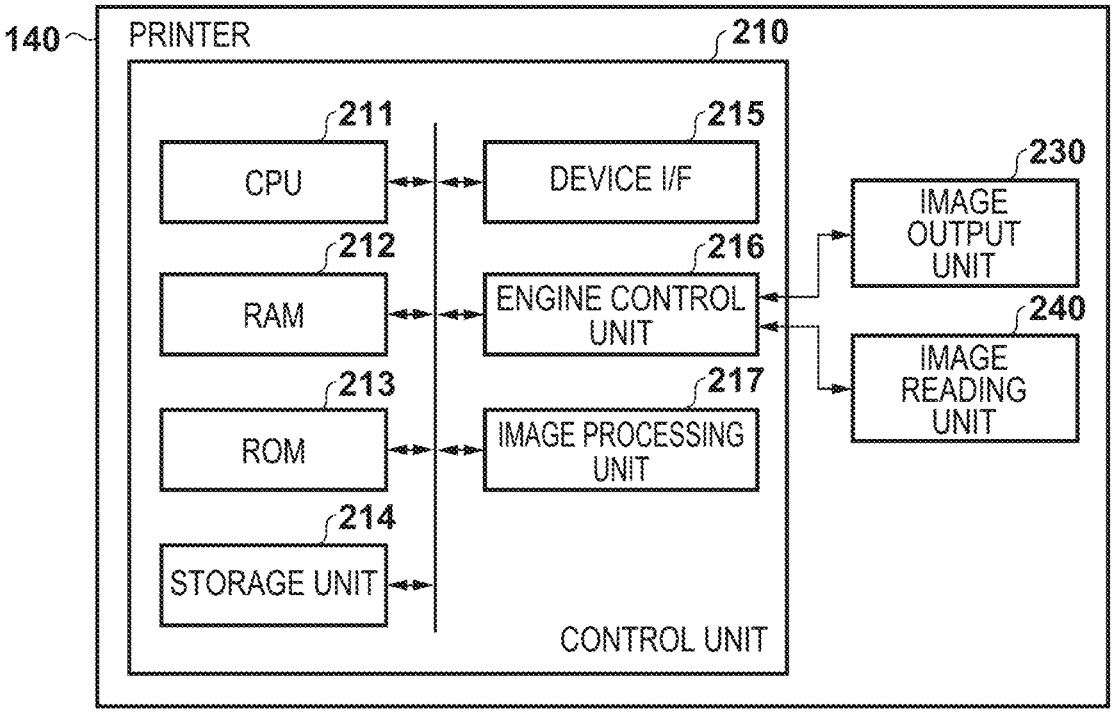
FIG. 1B is a block diagram illustrating an example of a hardware configuration of a printer.

FIG. 1B is a block diagram illustrating an example of a hardware configuration of the printer 140. The printer 140 comprises a control unit 210, an image output unit 230, and an image reading unit 240. The control unit 210 is connected with the image output unit 230 and the image reading unit 240. The control unit 210 comprises a CPU 211, a RAM 212, a ROM 213, a storage unit 214, a device I/F 215, an engine control unit 216, and an image processing unit 217.

The CPU 211 operates based on a program loaded into the RAM 212, and controls operation of the printer 140. The storage unit 214 stores information used in control by the control unit 210 and a program for controlling an operation of the printer 140, or the like. The device I/F 215 is an interface connected with the control unit 110, and performs synchronous/asynchronous conversion of image data exchanged via the interface. The engine control unit 216 controls operation of each unit that comprises in the printer engine including the image output unit 230 and the image reading unit 240.

The image processing unit 217 performs image processing on image data outputted to the image output unit 230 and image data inputted from the image reading unit 240. The image output unit 230 prints an image on a sheet based on the inputted image data. The image reading unit 240 is disposed on a conveyance path for a sheet on which an image is formed by the image output unit 230, and is configured to be able to read an image from a sheet outputted from the image output unit 230 and conveyed along the conveyance path. Note that a sheet may be called recording paper, a recording material, a recording medium, paper, a transfer material, a transfer sheet, or the like.

<MFP Functional Configuration>

Figure 2:
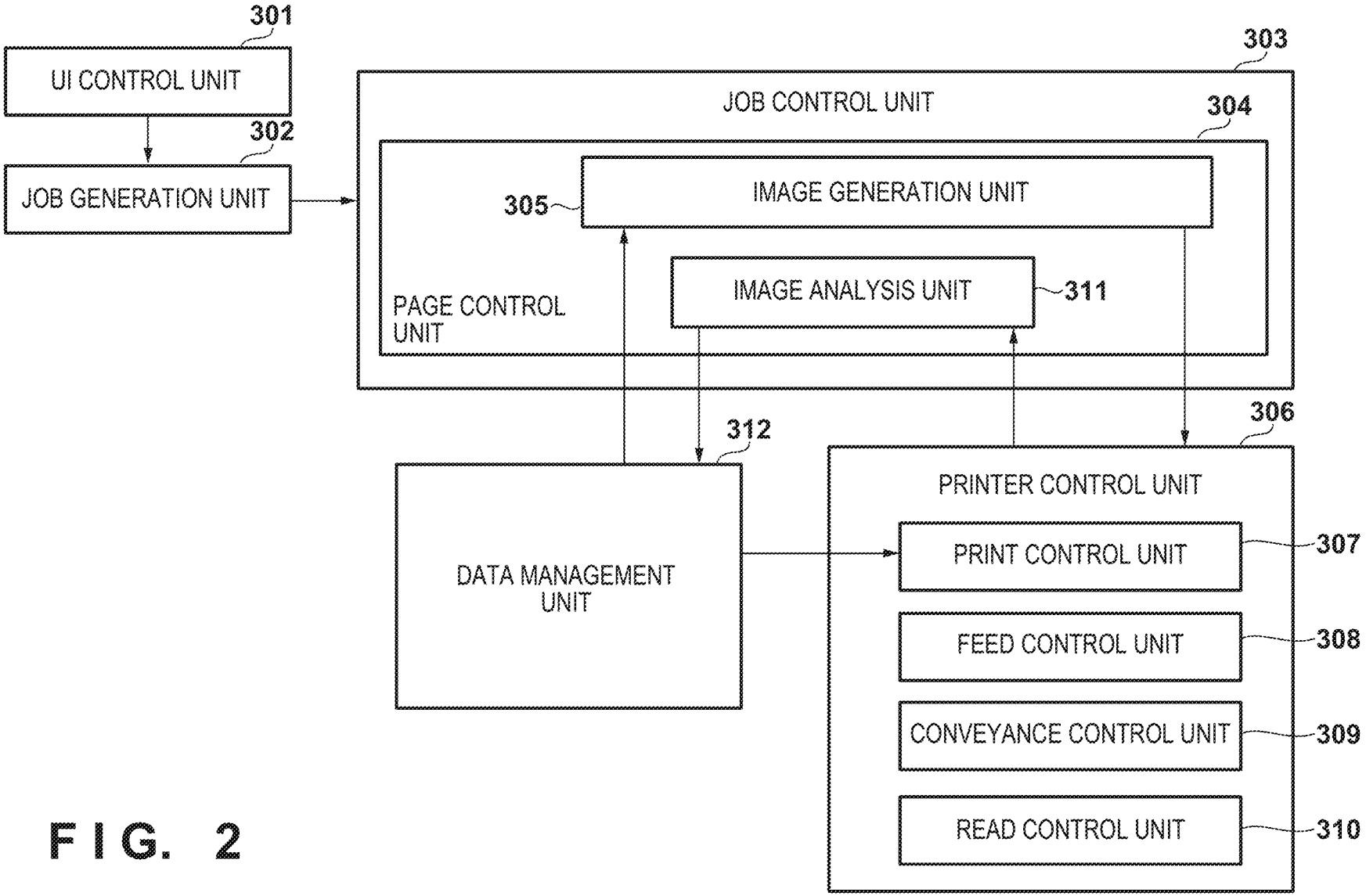
FIG. 2 is a block diagram illustrating an example of a functional configuration of an MFP control program.

FIG. 2 is a block diagram illustrating an example of a functional configuration of a control program of the MFP 100. The MFP 100 has a UI (user interface) control unit 301, a job generation unit 302, a job control unit 303, a printer control unit 306, and a data management unit 312.

The UI control unit 301 controls a display of an operation screen by the operation unit 150, and accepts input by the user via the operation screen. The job generation unit 302 has the functions of generating a print job, and registering the generated print job in the job control unit 303. The job generation unit 302 generates a print job based on print data that is received from the external apparatus, or based on input of a user that the UI control unit 301 received.

The job control unit 303 includes a page control unit 304, and causes the page control unit 304 to execute respective processing of the plurality of pages included in the registered print job. The job control unit 303, for each page, causes the processing of that page by the job control unit 303 to start by outputting a start notification that indicates the start of processing of that page to the page control unit 304. The job control unit 303, when notified from the page control unit 304 of the completion of the processing on all pages included in the print job, notifies the job generation unit 302 of the end of the print job.

The page control unit 304 includes an image generation unit 305 and an image analysis unit 311, and controls processing of each page in accordance with a start notification from the job control unit 303. The image generation unit 305 generates image data for printing corresponding to a processing target page in a bitmap format. Furthermore, the image generation unit 305 obtains from the data management unit 312 correction data corresponding to a sheet used for printing, and corrects the generated image data by applying the obtained correction data to the generated image data. Note that this correction includes at least one of later-described geometric correction (first correction) and tone correction (second correction). The image generation unit 305 outputs the corrected image data to the printer control unit 306 as image data for printing.

The printer control unit 306 includes a print control unit 307, a feed control unit 308, a conveyance control unit 309, and a read control unit 310, and each of them operates in accordance with instructions from the job control unit 303. The print control unit 307 controls the print operation by the printer 140 considering correction data obtained from the data management unit 312. The feed control unit 308 selects a paper feeding unit based on a designation in the print job, for example, and controls feeding of sheets to the conveyance path from the selected paper feeding unit. The conveyance control unit 309 controls conveyance of a sheet on the conveyance path.

The read control unit 310 controls reading of an image (image of an original) by the image reading unit 240 or scanner 130, and transmits to the image analysis unit 311 the image data (read image data) obtained by reading by the image reading unit 240 or the scanner 130. The image analysis unit 311, by analyzing read image data received from the read control unit 310, generates (obtains) correction data used for correction of image data for printing. The image analysis unit 311 transmits the generated correction data to the data management unit 312.

The data management unit 312 receives from the image analysis unit 311 correction data used for correction on image data generated by image generation unit 305 and manages the correction data. Note that the correction data is managed in a state in which it is stored in a storage device such as the RAM 112 or the storage unit 114.

<Correction Chart Output Settings>

The MFP 100 outputs a chart for output image correction onto a sheet, and based on the outputted chart, performs processing for generating correction data to be applied to the input image data. In the MFP 100 of the present embodiment, as the correction to be performed on the input image data, a geometric correction (first correction) that corrects a formation position of an output image on a sheet, and a tone correction (second correction) that corrects tone (density characteristics) of an output image can be performed. The geometric correction is a correction for improving the precision of a geometric positional adjustment of an output image to be outputted (printed) onto a sheet. The geometric correction includes correction of at least one of a write start position in the main scanning direction of the output image, a write start position in the sub-scanning direction of the output image, a scale factor for the main scanning direction of the output image, and a scale factor for the sub-scanning direction of the output image.

The correction data for the geometric correction and correction data for the tone correction is generated (obtained) by using a correction chart made up on images of respectively different patterns. The MFP 100 of the present embodiment, when performing a tone correction, performs output of a chart for geometric correction prior to output of a chart for tone correction. The MFP 100 is configured to be able to set the number of output sheets of the chart for geometric correction and the number of output sheets of the chart for tone correction for when performing the tone correction, in accordance with user input via the operation unit 150.

Figure 3:
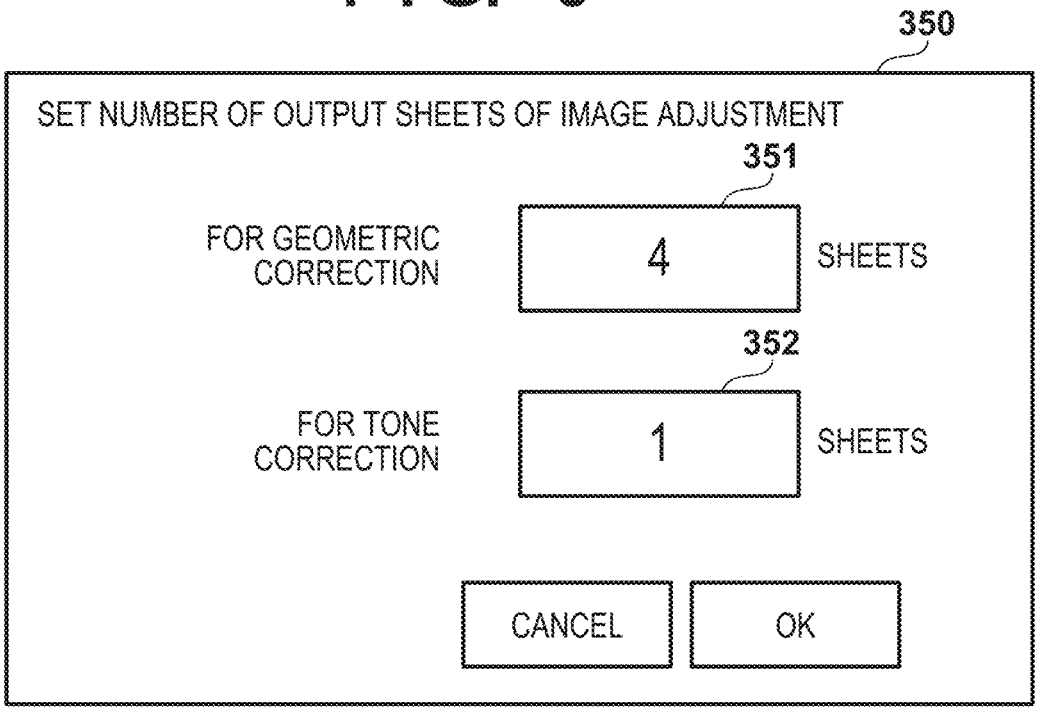
FIG. 3 illustrates an example of an operation screen for setting a number of output sheets of a correction chart.

FIG. 3 illustrates an example of an operation screen for setting the number of output sheets of the correction chart, that is displayed on the operation unit 150 by the CPU 111. The operation screen 350 of FIG. 3 includes a field 351 used for setting the number of output sheets (first number of output sheets) of the chart for geometric correction (first correction) and a field 352 used for setting the number of output sheets (second number of output sheets) of the chart for tone correction (second correction). The CPU 111 stores, in the storage unit 114, the number of output sheets set in the field 351 in the operation screen 350 as a setting value of the number of output sheets N1 of the chart for geometric correction (first correction). Also, the CPU 111 stores, in the storage unit 114, the number of output sheets set in the field 352 in the operation screen 350 as a setting value of the number of output sheets N2 of the chart for tone correction (second correction).

Note that the field 351 in the operation screen 350 may be configured to be able to set to two or higher as the number of output sheets of the chart for geometric correction. In such a case, in the print (output) processing of the later-described correction chart, a plurality of sheets on which the chart for geometric correction is printed are outputted, and then (one or more) sheets on which a chart for tone correction is printed are outputted. By this, it becomes possible to obtain the density correction data in a state in which the density of the output image when a chart for tone correction is outputted has stabilized.

<Correction Chart Output Processing>

Figure 4A:
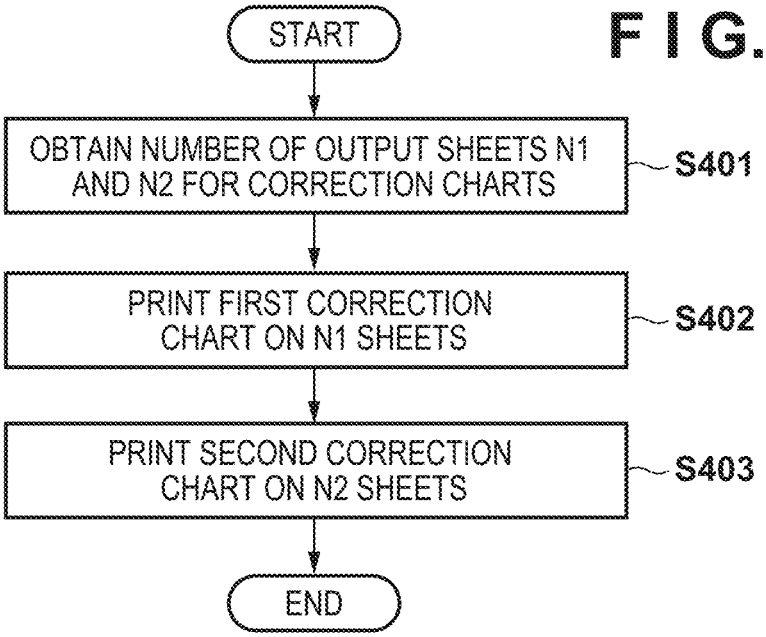
FIG. 4A is a flowchart illustrating a procedure for correction chart output processing.

FIG. 4A is a flowchart that illustrates the procedure of the output processing of a correction chart. The processing of each step of FIG. 4A is realized in the MFP 100 by the CPU 111 reading a control program stored into the ROM 113 into the RAM 112 and executing it.

In step S401, the CPU 111 obtains the number of output sheets N1 of the chart for first correction (geometric correction) and the number of output sheets N2 of the chart for second correction (tone correction). The numbers of output sheets N1 and N2 are stored in the storage unit 114 set in advance. The CPU 111 obtains the setting values of the numbers of output sheets N1 and N2 by reading them out from the storage unit 114.

Next, in step S402, the CPU 111 controls the printer 140 to repeat the processing for printing the first correction chart (chart for first correction) onto the sheet N1 times to thereby print the first correction chart onto N1 sheets, and advances the processing to step S403. Next, in step S403, the CPU 111 controls the printer 140 to repeat the processing for printing the second correction chart (chart for second correction) onto the sheet N2 times to thereby print the second correction chart onto N2 sheets, and ends the processing according to the procedure of FIG. 4A. In this way, in the present embodiment, the CPU 111 performs processing for outputting N1 sheets on which the first correction (geometric correction) chart is printed, and then outputting N2 sheets on which the second (tone correction) chart is printed.

<Correction Chart Read Processing>

Figure 4B:
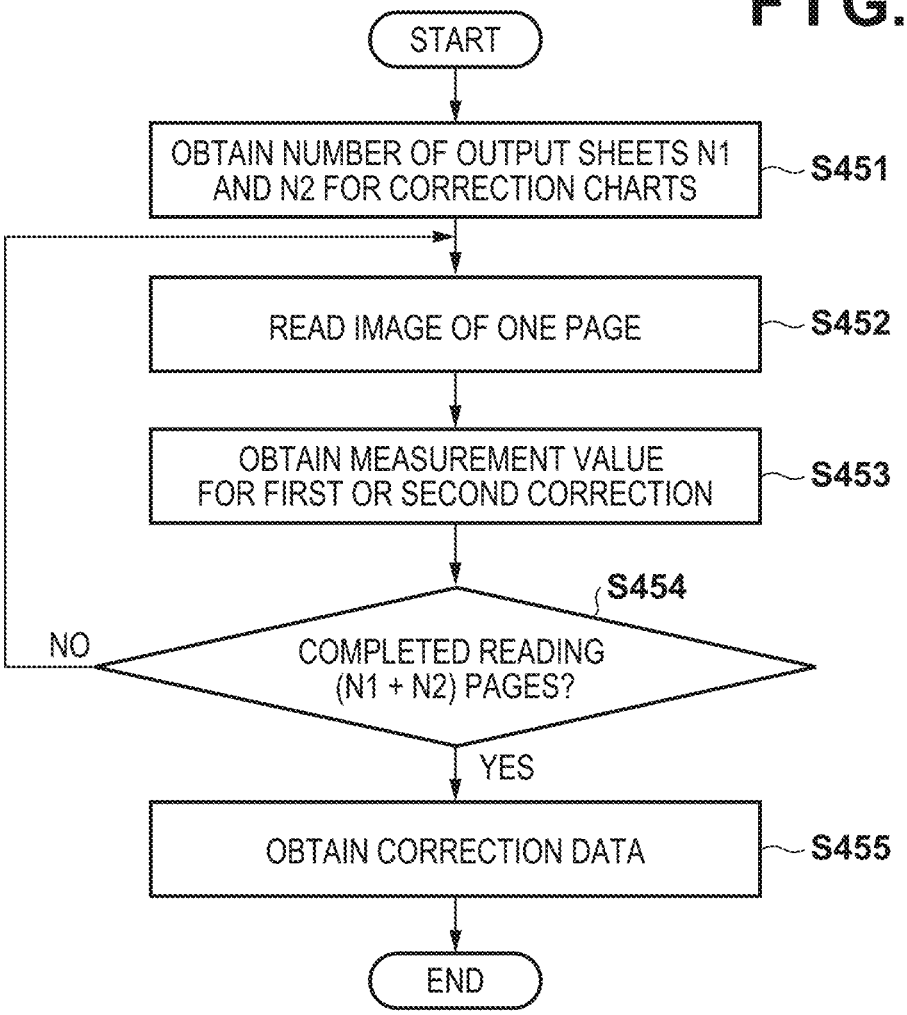
FIG. 4B is a flowchart that illustrates a procedure for a correction chart read processing.

FIG. 4B is a flowchart illustrating a procedure of processing for reading correction charts. The processing of each step of FIG. 4B is realized in the MFP 100 by the CPU 111 reading a control program stored in the ROM 113 into the RAM 112 and executing it.

In step S451, the CPU 111, similarly to step S411, obtains the number of output sheets N1 of the first correction chart and the number of output sheets N2 of the second correction chart, and advances the processing to step S452.

In step S452, the CPU 111 controls the scanner 130 or the image reading unit 240 to perform reading of an image (first or second correction chart) of one page from a sheet that is a reading target. In a case when the scanner 130 is used, a user sets a sheet on which the first or second correction chart is printed in the scanner 130, and instructs the start of reading of the correction chart via the operation unit 150. Also, in a case when the image reading unit 240 is used, in the printer 140, after printing the first or second correction chart on a sheet, a read is performed by the image reading unit 240 during conveyance of the sheet. The scanner 130 or the image reading unit 240 outputs to the CPU 111 a one page read image obtained by reading an image (first or second correction chart) of a sheet.

In step S453, the CPU 111 obtains a sampling result of the measurement value used to generate correction data for the first correction (geometric correction) or the second correction (tone correction) in relation to a read image outputted from the scanner 130 or the image reading unit 240. In the case of the scanner 130 being used for reading of the image, the image processing unit 118 is used for sampling of the measurement values, and the sampling result is transferred to the CPU 111. In the case of the image reading unit 240 being used for reading of the image, the image processing unit 217 is used for sampling of the measurement values, and the sampling result is transferred to the CPU 111 via the device I/Fs 215 and 116.

In step S454, the CPU 111 determines whether or not reading of images of (N1+N2) pages has completed, and if it determines that it has completed, advances the processing to step S455, and if it determines that the reading of images of (N1+N2) pages has not completed, returns the processing to step S452. By this, the reading of images and the sampling of measurement values from the read images is repeated across (N1+N2) pages, and the sampling result of the measurement values corresponding to the read images of the (N1+N2) pages is obtained. Note that the CPU 111 can count the number of times out of the N1 times that the sampling of measurement values for the first correction chart succeeded and the number of times out of the N2 times that the sampling of measurement values for the second correction chart succeeded. Also, the CPU 111 may further count the number of times that either sampling of the measurement values for the first correction chart and sampling of the measurement values for the second correction chart did not succeed. These count values may be used for generation of correction data in step S455.

In step S455, the CPU 111, based on the sampling results of measurement values obtained in step S455, generates (obtains) correction data for first correction (geometric correction) and correction data for second correction (tone correction), and ends the processing of the procedure of FIG. 4B.

<Correction Data for Tone Correction>

Figure 5A:
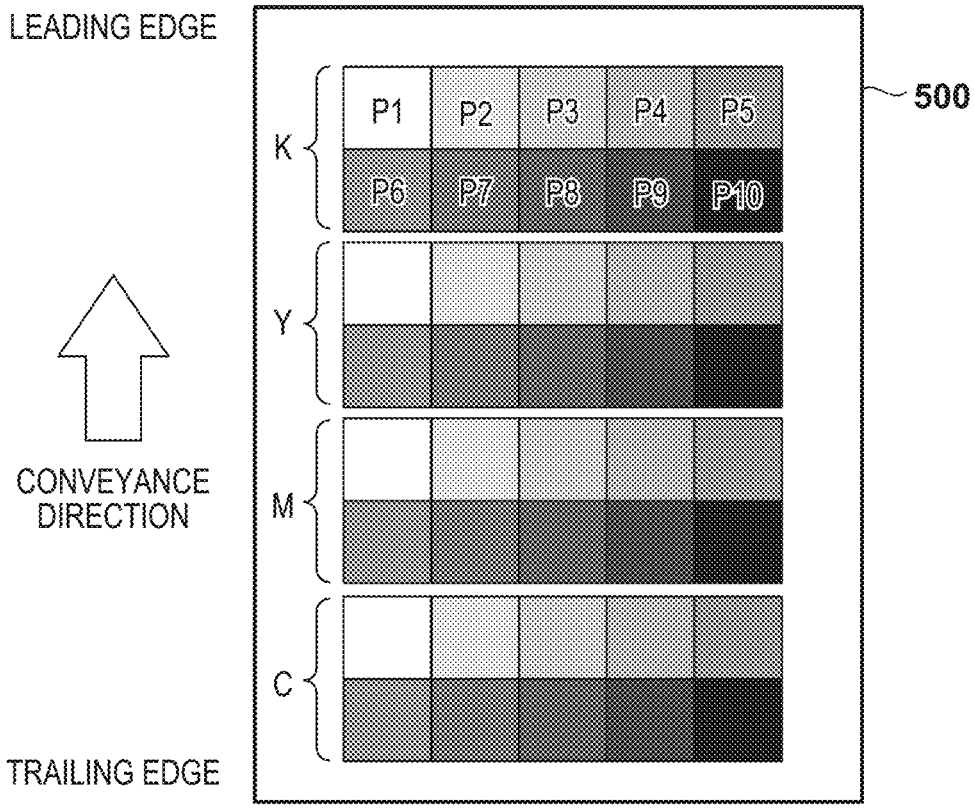
FIG. 5A illustrates an example of a chart for tone correction.

FIG. 5A illustrates an example of a chart for tone correction in the MFP 100. In the MFP 100 of the present embodiment, a tone correction of an output image formed on a sheet is performed as the above-described second correction. A chart 500, during execution of the tone correction, is printed on the sheet, and reading is performed by the image reading unit 240 or the scanner 130. Based on the read result, correction data (density correction data) for the tone correction is generated by the image analysis unit 311.

As illustrated in FIG. 5A, the chart 500 for tone correction is an image of a predetermined pattern including a plurality of patch groups corresponding to respectively different colors (yellow (Y), magenta (M), cyan (C), or black (K)). Each patch group is configured by a plurality of patches of the corresponding colors, the plurality of patches having respectively different densities. In the example of FIG. 5A, as one example, each patch group includes a plurality of patches respectively corresponding to ten steps of density levels L1 to L10. Note that the chart 500 is one example of an image of a second pattern for tone correction of the output image.

FIG. 5B illustrates an example of generation of correction data based on read results obtained by reading the chart 500 printed on the sheet in the image reading unit 240 or the scanner 130. The tone correction is processing that, for each color Y, M, C, and K, corrects the signal value of the input image (the printing target image) using a correction value included in the correction data. Specifically, the signal value corresponding to each density level in the input image is corrected using the correction value corresponding to the density level. The correction value is generated based on the measurement value obtained by reading of the chart 500 and a target value corresponding thereto.

In FIG. 5B, the table 510 includes, as its elements, target values of each color Y, M, C, and K respectively corresponding to the density levels L1 to L10. The table 520 includes, as its elements, measurement values of image signals of each color Y, M, C, and K corresponding respectively to the density levels L1 to L10. A table 530 includes, as its elements, correction values generated based on a measurement value included in the table 520 and a corresponding target value included in the table 510. In the present example, each correction value is calculated as a difference of a measurement value in relation to a target value. The correction data illustrated as the table 530 is managed by the data management unit 312 in a state in which it is stored in the storage device as correction data for tone correction.

<Correction Data for Geometric Correction>

Figure 6:
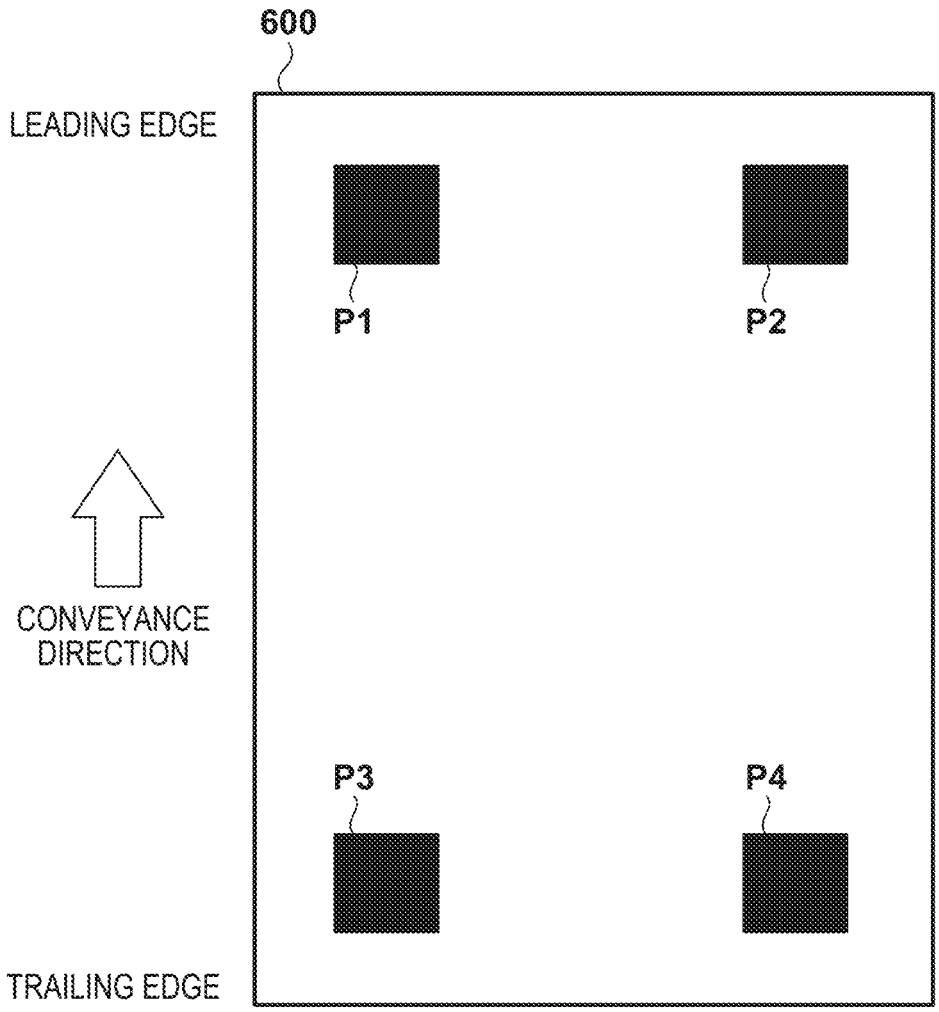
FIG. 6 illustrates an example of a chart for geometric correction.

FIG. 6 illustrates an example of a chart for geometric correction in the MFP 100. In the MFP 100 of the present embodiment, a geometric correction for correcting a formation position of an output image on a sheet is performed as the above-described first correction. The chart 600, during execution of a geometric correction, is printed onto the sheet, and reading by the image reading unit 240 or the scanner 130 is performed. Based on the read result, correction data for geometric correction is generated by the image analysis unit 311.

As illustrated in FIG. 6, a chart 600 for geometric correction is configured by a plurality of marks (patches) for measuring a positional deviation from an ideal position of the output image on the sheet. In the example of FIG. 6, the chart 600 includes patches P1 and P2 positioned at a first position in the direction of conveyance of sheets (sub-scanning direction) and patches P3 and P4 arranged at a second position in the sub-scanning direction. The patches P1 and P3 are arranged at the same position in a direction (main scanning direction) orthogonal to the direction of conveyance of the sheets, and the patches P2 and P4 are arranged at the same position in the main scanning direction. Note that the plurality of patches used in the geometric correction need not have respectively different densities (have halftone densities) as with the plurality of patches used in the tone correction. Accordingly, the plurality of patches P1 to P4 included in the chart 600 may be constituted by a plurality of patches having a single density. Note that the chart 600 is one example of an image of a first pattern for correcting a formation position of the output image on the sheet.

Figure 7A:
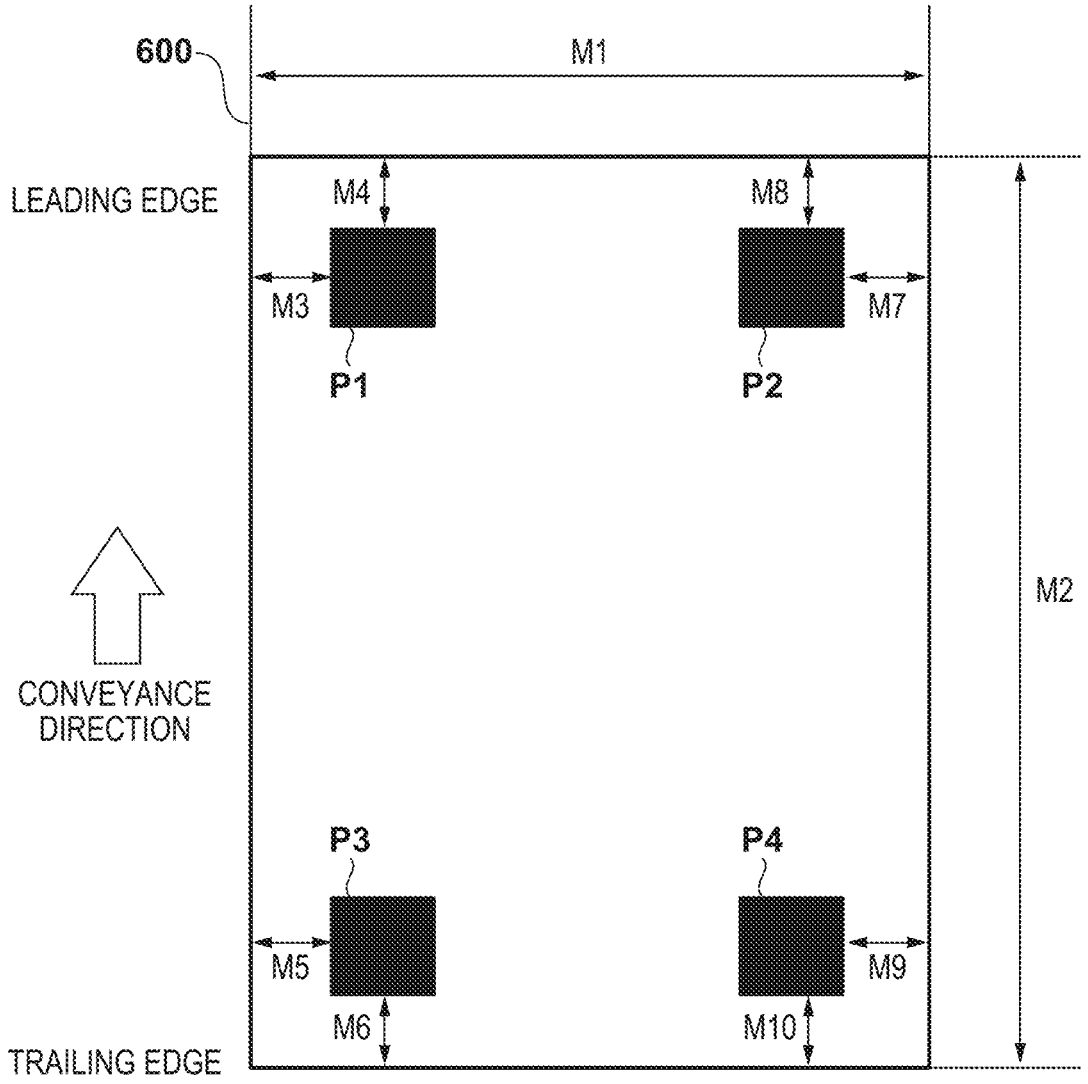

The image analysis unit 311 performs measurement of distances M1 to M10 illustrated in FIG. 7A on a read image obtained by reading by the image reading unit 240 or the scanner 130. M1 and M2 are respectively lengths in the main scanning direction and the sub-scanning direction of the chart 600, and respective ideal values are sheet lengths defined by a sheet library. M3 to M10 are respectively distances to the leading edge of the sheet from each patch.

The image analysis unit 311, based on the measurement values of M1 to M10, use the expressions shown in FIG. 7B to respectively obtain measurement values for a leading write start position, a left edge write start position, a main-scanning magnification, and a sub-scanning magnification. The leading write start position is an image write start position in sub-scanning direction, and the left edge write start position is an image write start position in the main scanning direction. Furthermore, the image analysis unit 311, as illustrated in FIG. 7B, obtains a correction value based on the obtained measurement value and the corresponding ideal value. The correction data including each calculated correction value is managed by the data management unit 312 in a state stored in the storage device as the correction data for geometric correction.

<Processing Procedure>

Figure 8:
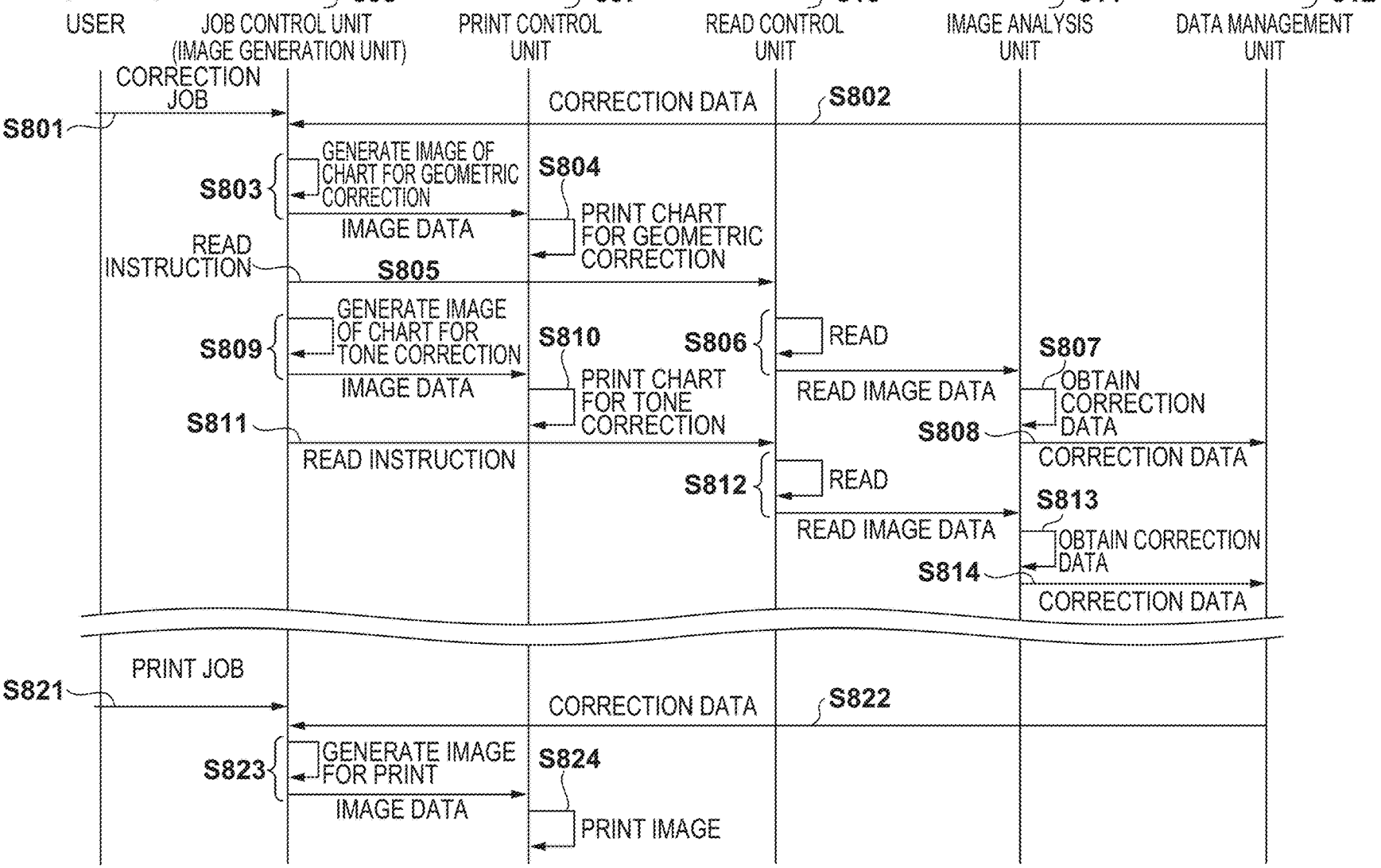
FIG. 8 is a sequence diagram for processing for obtaining correction data and normal printing.

FIG. 8 is a sequence diagram for processing executed to obtain correction data and perform normal printing in the MFP 100. In the present example, reading of a correction chart from the sheet is performed using the image reading unit 240, but the scanner 130 may be used for reading of a correction chart. Note that a correction job includes processing for printing a chart for first correction (geometric correction) on N1 sheets, processing for then printing a chart for second correction (tone correction) on N2 sheets, and processing for obtaining correction data based on the result of reading each sheet.

(Correction Processing)

In step S801, the job control unit 303 receives input of a correction job from a user. When the correction job is inputted, in step S802, the job control unit 303 (image generation unit 305) obtains correction data for a first correction and correction data for a second correction from the data management unit 312. In a correction job, print processing for a first correction chart is performed, and after completing the print processing, then print processing for a second correction chart is performed.

Specifically, in step S803, the job control unit 303 (image generation unit 305) generates image data of a first correction chart for which the first and second corrections that use the obtained correction data is applied. The job control unit 303 (image generation unit 305) outputs, to the printer control unit 306 (the print control unit 307), the generated image data. In step S804, the print control unit 307, based on the image data outputted from image generation unit 305, controls the printer 140 so as to print a first correction chart in N1 sheets.

Furthermore, in step S805, the job control unit 303 makes an image read instruction to the read control unit 310. In step S806, the read control unit 310 controls the image reading unit 240 so as to perform image reading from each sheet on which the first correction chart is printed and that is conveyed. The read control unit 310 outputs read image data obtained by reading by the image reading unit 240 to the image analysis unit 311. The image analysis unit 311, in step S807, performs analysis of read image data to generate correction data for a first correction, and in step S808, registers in the data management unit 312 the generated correction data.

When printing of the first correction chart completes in step S804, the job control unit 303 (image generation unit 305) then starts processing for printing the second correction chart. Note that, as illustrated in FIG. 8, print processing for the second correction chart (steps S809 and S810) may be executed in parallel to the reading of the first correction chart and generation of correction data (steps S806 to S808).

Specifically, in step S809, the job control unit 303 (image generation unit 305) generates image data of a second correction chart for which the first and second corrections that use the obtained correction data are applied. The job control unit 303 (image generation unit 305) outputs the generated image data to the printer control unit 306. In step S810, the printer control unit 306 (print control unit 307), based on the image data outputted from the image generation unit 305, controls the printer 140 so as to print a second correction chart onto N2 sheets.

Also, in step S811, the job control unit 303 makes an image read instruction to the read control unit 310. In step S812, the read control unit 310 controls the image reading unit 240 to perform image reading from each sheet on which the second correction chart is printed and that is conveyed. The read control unit 310 outputs read image data obtained by reading by the image reading unit 240 to the image analysis unit 311. The image analysis unit 311, in step S813, performs analysis of read image data to generate correction data (density correction data) for a second correction, and in step S814, registers the generated correction data in the data management unit 312.

(Normal Print Processing)

Normal print processing based on a print job including input image data is executed as follows at a different timing to the above-described correction processing. In step S821, the job control unit 303 (the image generation unit 305) receives input of a print job from a user. When the print job is inputted, in step S822, the job control unit 303 (image generation unit 305) obtains correction data for a first correction and correction data for a second correction from the data management unit 312. In step S823, the image generation unit 305 applies the first and second corrections that use the obtained correction data to the input image data to generate image data for printing, and outputs the generated image data to the printer control unit 306. Accordingly, the image generation unit 305, based on the density correction data obtained by the image analysis unit 311, corrects the input image data used for image formation by the printer 140. In step S824, the printer control unit 306 (print control unit 307) controls the printer 140 to print an image onto a sheet based on image data outputted from the image generation unit 305.

<Example of Output of a Correction Chart>

Figure 9:
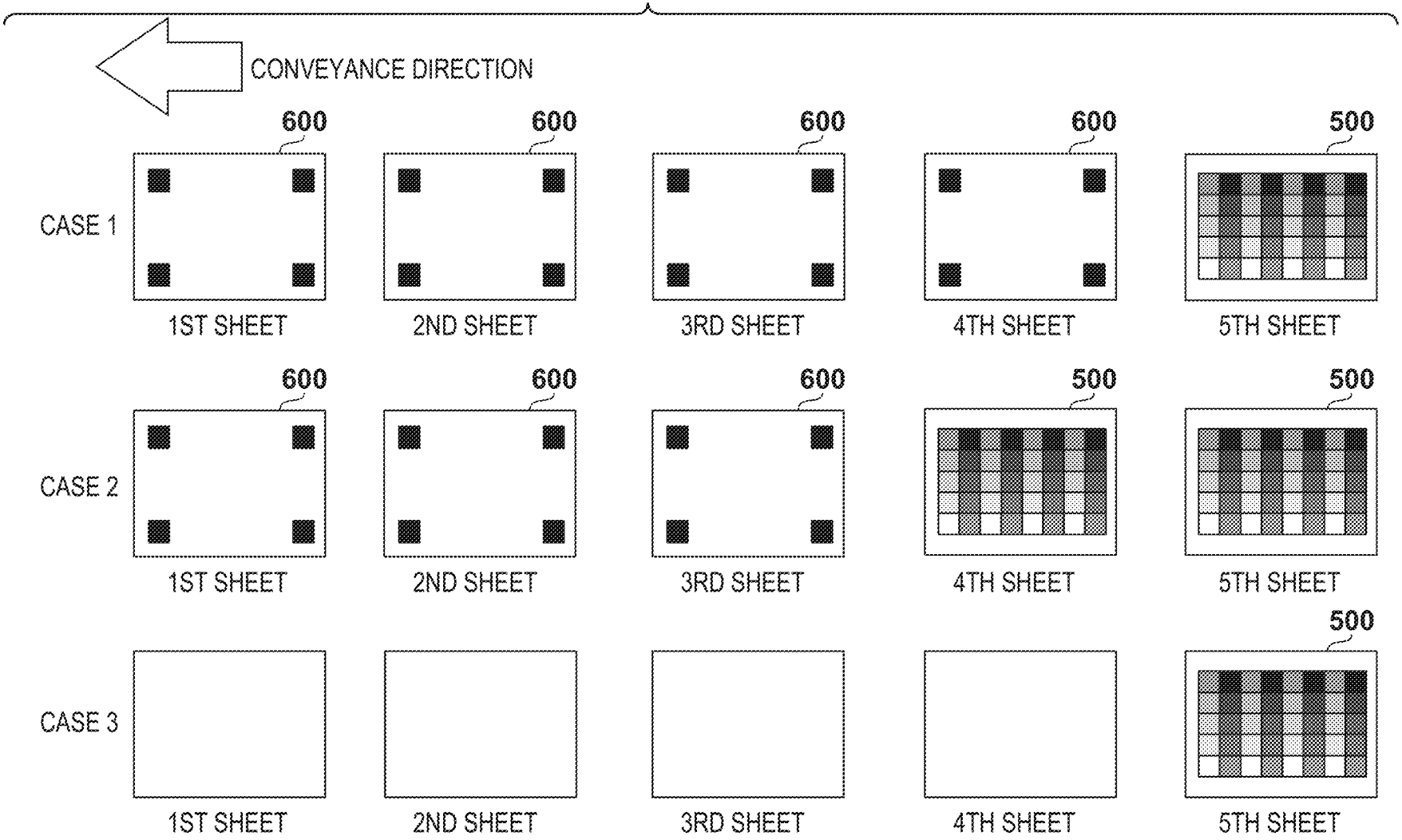
FIG. 9 illustrates an example of outputting a correction chart.

FIG. 9 illustrates three examples (cases 1 to 3) of outputting a correction chart when tone correction is performed in the MFP 100 according to the present embodiment. In the present embodiment, the MFP 100 performs output of a sheet on which a chart 600 for geometric correction is printed prior to output of a sheet on which a chart 500 for tone correction is printed as in case 1 and case 2.

Case 1 is an example of output of a correction chart in a case when N1=4 and N2=1 is set. In this case, the MFP 100 outputs four sheets on which the chart 600 for geometric correction is printed, and then outputs one sheet on which the chart 500 for tone correction is printed. In this way, by printing of the chart 600 for geometric correction prior to printing of the chart for tone correction 500, it becomes possible to print the chart 500 in a state in which a density characteristic of an output image is stabilized.

Since the sheet on which the chart 600 for geometric correction is printed is used for obtaining correction data for geometric correction, the resources (such as sheets and toner) used for the printing do not end up being wasted. Note that even if density characteristics of the output image have not stabilized at the time of printing the chart 600, it is possible to obtain correction data for the geometric correction. Accordingly, the density correction data can be obtained by reading of the chart 500 in a state in which the density characteristics of the output image have stabilized, without wasting resources used for image formation. Also, as in this case, by outputting a plurality of sheets on which the chart 600 for geometric correction is printed (by increasing the number of output sheets for the chart 600), it becomes possible to stabilize the density of the output image more when the chart for tone correction is outputted.

Case 2 is an example of outputting a correction chart in a case when N1=3 and N2=2 is set. In this case, the MFP 100 outputs three sheets on which the chart 600 for geometric correction is printed, and then outputs two sheets on which the chart 500 for tone correction is printed. In this case as well, similarly to case 1, the density correction data can be obtained by reading of the chart 500 in a state in which the density characteristics of the output image have stabilized, without wasting resources used for image formation. Also, by outputting a plurality of sheets on which the chart 500 for tone correction is printed, it is possible to increase the precision of the density correction data by, for example, averaging the correction values obtained by reading each sheet.

Case 3 illustrates, as a variation of the present embodiment (cases 1 and 2), an example in which, prior to outputting a sheet on which the chart 500 for tone correction is printed, blank sheets are outputted (in this case, four blank sheets are outputted). In this case, when outputting the blank sheets, the print control unit 307 performs processing for causing a sheet to be outputted from the image output unit 230 without performing image formation. In other words, the image output unit 230 (printer 140) performs a similar operation to the normal print operation so as to output the blank sheets. Accordingly, similarly to case 1, it becomes possible to print the chart 500 for tone correction on the fifth sheet in a state in which the density characteristics of the output image have stabilized.

Accordingly, it becomes possible to obtain density correction data by reading the chart 500 in a state in which the output image density characteristics stabilized, without wasting resources used for image formation. Also, in case 3, since output of the chart 600 for geometric correction is not performed in contrast to case 1 and 2, it becomes possible to obtain density correction data for tone correction while economizing on toner.

<Conclusion>

As described above, the MFP 100 of the present embodiment outputs a sheet for which the first processing is performed, and then outputs a sheet for which the second processing for forming an image of a predetermined pattern by the image output unit 230 (printer 140) is performed. Furthermore, the MFP 100 obtains density correction data used for image formation by the image output unit 230 (printer 140) based on the read image obtained by reading by the image reading unit 240 (or the scanner 130) a sheet for which the second processing was performed. As one example in the present embodiment, the first processing is processing for printing, onto a sheet, an image (example: chart 600) of a first pattern for a geometric correction, and the second processing is processing for printing, onto a sheet, an image (example: the chart 500) of a second pattern for tone correction.

In this way, prior to outputting a sheet for which the second processing was performed, a sheet for which the first processing was performed is outputted, such that it becomes possible to print an image (example: chart 500) of a predetermined pattern in a state in which the density characteristic of the output image has stabilized. The sheet for which the second processing was performed in this way is used to obtain the density correction data. Also, the sheet for which the first processing was performed is used to obtain the correction data for geometric correction, for example, and by this, resources for image formation can be utilized effectively. Accordingly, by virtue of the present embodiment, it becomes possible to obtain density correction data in a state in which the density characteristic of the output image is stabilized without wasting resources for image formation.

Also, in the present embodiment, first processing may be processing other than a process for printing an image of a first pattern for the geometric correction onto a sheet. For example, the first processing may be processing for causing a sheet to be outputted from the image output unit 230 (the printer 140) without performing image formation. In such a case, it becomes possible to obtain density correction data in a state in which the density characteristics of the output image have stabilized without wasting resources used for image formation.

Other Embodiments

Embodiment(s) of the present invention can also be realized by a computer of a system or an apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., an application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming device configured to form an image on a sheet;

an image reading device configured to read an image from the image on the sheet; and one or more controllers configured to function as:

a processing unit configured to cause the image forming device to perform a predetermined image formation for forming a first image for position correction of an output image and then to form a second image for tone correction of an output image; and an obtaining unit configured to obtain a value of the position correction based on a read image read from a first image sheet on which the first image is formed, and to obtain a value of the tone correction based on a read image read from a second image sheet on which the second image is formed.

2. The image forming apparatus according to claim 1, wherein the first image is formed of a plurality of patches having a single density, and the second image is formed by a plurality of patches having respectively different densities.

3. The image forming apparatus according to claim 1, wherein the position correction of the output image includes correction of at least one among a write start position of a main scanning direction of the output image, a write start position of a sub-scanning direction of the output image, a scale factor for the main scanning direction of the output image, and a scale factor for the sub-scanning direction of the output image.

4. The image forming apparatus according to claim 1, wherein the processing unit performs processing for outputting a plurality of first image sheets on each of which the second image is formed.

5. The image forming apparatus according to claim 1, wherein the one or more controllers is configured further to function as a setting unit configured to set, in accordance with an input of a user, a first number of output sheets on which the first image is formed and a second number of output sheets on which the second image is formed, and wherein the processing unit performs performs operation for outputting the first number of output sheets on which the first image is formed, and then outputting the second number of output sheets on which the second image is formed.

6. The image forming apparatus according to claim 5, wherein the setting unit is configured to be able to set two or higher as the first number of output sheets.

7. The image forming apparatus according to claim 1, wherein the image reading unit is arranged on a conveyance path of a sheet that is to be outputted from the image forming device, and is configured to be able to read the image formed sheet that is outputted from the image forming apparatus and conveyed along the conveyance path.

8. The image forming apparatus according to claim 1, wherein the one or more controllers is configured further to function as a correction unit configured, based on the value of the tone correction obtained by the obtaining unit, to correct input image data to be used for image formation by the image forming device.

9. A method of controlling an image forming apparatus that comprises an image forming unit configured to form an image on a sheet and an image reading unit configured to read an image from a sheet, the method comprising:

forming an image on a sheet by the image forming device;

reading an image from the image on the sheet by the image reading device;

causing the image forming device to perform a predetermined image formation for forming a first image for position correction of an output image and then forming a second image for tone correction of an output image; and obtaining a value of the position correction based on a read image read from a first image sheet on which the first image is formed, and obtaining a value of the tone correction based on a read image read from a second image sheet on which the second image is formed.

10. A non-transitory computer-readable storage medium storing a computer program for causing a computer to execute a method of controlling an image forming apparatus that comprises an image forming unit configured to form an image on a sheet and an image reading unit configured to read an image from a sheet, the method comprising:

forming an image on a sheet by the image forming device;

reading an image from the image on the sheet by the image reading device;

causing the image forming device to perform a predetermined image formation for forming a first image for position correction of an output image and then forming a second image for tone correction of an output image; and obtaining a value of the position correction based on a read image read from a first image sheet on which the first image is formed, and obtaining a value of the tone correction based on a read image read from a second image sheet on which the second image is formed.

* * * * *